US012252322B2

(12) United States Patent
Stadel et al.

(10) Patent No.: US 12,252,322 B2
(45) Date of Patent: Mar. 18, 2025

(54) VALVE FOR A PACKAGING CONTAINER

(71) Applicant: Syntegon Technology GmbH, Waiblingen (DE)

(72) Inventors: Hans-Peter Stadel, Lorch (DE); Jenny Haase, Allmersbach (DE); Holger Poell, Stuttgart (DE)

(73) Assignee: Syntegon Technology GmbH, Waiblingen (DE)

( * ) Notice: Subject to any disclaimer, the term of this patent is extended or adjusted under 35 U.S.C. 154(b) by 293 days.

(21) Appl. No.: 17/640,070

(22) PCT Filed: Sep. 18, 2020

(86) PCT No.: PCT/EP2020/076114
§ 371 (c)(1),
(2) Date: Mar. 3, 2022

(87) PCT Pub. No.: WO2021/053149
PCT Pub. Date: Mar. 25, 2021

(65) Prior Publication Data

US 2022/0332489 A1 Oct. 20, 2022

(30) Foreign Application Priority Data

Sep. 19, 2019 (DE) ..... 10 2019 214 315.6

(51) Int. Cl.
*B65D 77/22* (2006.01)

(52) U.S. Cl.
CPC ..... *B65D 77/225* (2013.01)

(58) Field of Classification Search
CPC ... B65D 77/225; B65D 33/01; B65D 2205/00
See application file for complete search history.

(56) References Cited

U.S. PATENT DOCUMENTS 5,727,881 A 3/1998 Domke
6,662,827 B1 12/2003 Clougherty et al.
8,038,023 B2 * 10/2011 Moore ..... B65D 77/225 220/745

(Continued)

FOREIGN PATENT DOCUMENTS

DE 2625350 A1 12/1977
DE 102004062026 A1 3/2006

(Continued)

OTHER PUBLICATIONS

Translation of DE 102004061262 from Espacenet. (Year: 2024).*

(Continued)

*Primary Examiner* — James N Smalley
(74) *Attorney, Agent, or Firm* — Michael Best & Friedrich LLP

(57) ABSTRACT

A valve for a packaging container includes at least one base film (10) with an opening (11), at least one frame film (13) encompassing a free region (17), wherein the frame film (13) is connected to the base film (10), wherein at least one membrane (12) is provided, which is arranged on the base film (10) and covers the opening (11), wherein a fluid is provided between the membrane (12) and the base film (10), wherein the membrane (12) is arranged movably within the free region (17) on the base film (10).

19 Claims, 5 Drawing Sheets

(56) References Cited

U.S. PATENT DOCUMENTS

| | | | | |
|---|---|---|---|---|
| 10,311,759 | B2 * | 6/2019 | Birk | B65D 25/205 |
| 2005/0103798 | A1 | 5/2005 | Luigi | |
| 2008/0011751 | A1 | 1/2008 | Stotkiewitz et al. | |
| 2012/0048853 | A1 | 3/2012 | Stadel et al. | |
| 2012/0243807 | A1 | 9/2012 | Pascoe | |
| 2013/0048125 | A1 | 2/2013 | Hoffman et al. | |
| 2020/0239214 | A1 | 7/2020 | Knappe et al. | |

FOREIGN PATENT DOCUMENTS

| | | | | |
|---|---|---|---|---|
| DE | 102004061262 | A1 * | 6/2006 | B65D 77/225 |
| DE | 102006016594 | A1 | 10/2007 | |
| DE | 102019200860 | A1 | 7/2020 | |
| EP | 0760790 | B1 | 6/2000 | |
| EP | 1538107 | A2 | 6/2005 | |
| EP | 2396244 | B1 | 12/2011 | |
| EP | 2719637 | A1 | 4/2014 | |
| GB | 1583503 | A | 1/1981 | |
| JP | H0324379 | A | 2/1991 | |
| JP | 2014076858 | A | 5/2014 | |

OTHER PUBLICATIONS

Translation of International Search Report for Application No. PCT/EP2020/076114 dated Dec. 8, 2020 (2 pages).

Japanese Patent Office Action for Related Application No. 2022517304 dated Mar. 22, 2023 (6 pages, including an English translation).

German Patent Office Search Report for Application No. DE 10 2019 214 315.6 dated Aug. 7, 2020 (9 pages including English translation).

International Preliminary Report on Patentability for Application No. PCT/EP2020/076114 dated Mar. 15, 2022 (6 pages).

European Patent Office Action for Application No. 20775845.9 dated Jul. 26, 2023 (7 pages, English translation included).

* cited by examiner

VALVE FOR A PACKAGING CONTAINER

BACKGROUND

The present invention concerns a valve, in particular an overpressure valve for a packaging container.

Valves of this kind are used in packaging technology if the filling material tends to outgassing, as is the case, for example, with freshly roasted coffee. Thus an overpressure valve for a packaging container is known, for example, from EP 760790 B1, with a base plate that is fastened to the wall of the packaging container and comprises a central valve hole covering a through hole in the wall of the packaging container, and with a valve membrane which covers the valve hole and is fastened to the base plate with two parallel edge zones leaving a channel zone free, the valve membrane lying tightly upon the base plate in a closed position. The valve hole is formed of at least two intersecting and/or overlapping circle-shaped openings. From EP 2396244 B1 a generic overpressure valve is known, comprising a base body with a two-step deepening and a membrane, the membrane having a deformable surface that is oriented toward a sealing surface. The base body has a rather complex structure.

SUMMARY

With respect thereto, the valve for a packaging container according to the invention has the advantage that the valve can be produced in a simpler manner. Moreover the function of the valve is improved. The valve is furthermore distinguished by reduced production costs. The principal construction of the valve may be attached to the packaging container both outside the packaging container as well as, in a certain exemplary implementation, within the packaging container. This is enabled, according to the invention, by the membrane being at least partly arranged on a base film floating and/or freely movable within the free region. The membrane is thus no longer connected to the base body over a large area and is therefore considerably less subject to external influences, like for example warpage. The proposed construction with a base film, a frame film and, if applicable, a cover film (quasi something like a double-T beam) results in a high degree of bending stiffness with comparably little material input. The valve combines the favorable valve characteristics of an injection-molded valve with those of a film valve. It provides very low opening pressures and closing pressures. The valve is built from several film layers which are, for example, produced on rotary punching tools and are then laminated upon one another. Joining is ideally brought about via a welding connection. Alternatively, an adhesive agent like glue could be applied. The proposed valve is preferentially producible from a single type of material and is thus easily recyclable and hence environment-friendly and/or has improved welding properties. In an expedient further development, the film is made of polypropylene. However, renewable materials, e. g. synthetic materials based on sustainable raw materials or bio-degradable synthetic materials would also be conceivable.

In an expedient further development, the frame film is implemented so as to encompass the membrane at least partly or completely, such that the membrane cannot leave the free region.

In an expedient further development, the frame film has at least one interruption such that first a channel is formed. This channel allows dispelling of an overpressure that is potentially produced. Providing precisely one interruption ensures a preferentially one-part implementation of the frame film. This facilitates handling and application of the frame film.

Especially expediently, the free region is formed in a circular shape, with a radius that is greater than a radius of the membrane that is embodied in a circle shape. This arrangement is particularly simply producible and moreover ensures sufficient freedom of movement of the membrane. Particularly preferentially a thickness of the frame film is greater than a thickness of the membrane, such that lifting of the membrane off the opening is reliably achievable.

In an expedient further development, the thickness of the frame film is greater than the thickness of the membrane, preferably greater by 75% to 225%. This allows particularly secure lifting of the membrane.

In an expedient further development, at least one cover film is provided, which is connected to the frame film. In particular in the case of an outside-situated valve the membrane is thus protected from environmental influences while it is ensured that the membrane cannot lift off completely, i. e. cannot get separated from the base body and/or get lost.

In an expedient further development, the base film and/or the frame film and/or the cover film are/is implemented of polypropylene, OPP, PET, polyolefin or of a synthetic material, preferably of sustainable raw materials or of bio-degradable synthetic materials. This allows augmenting re-usability and/or environmental compatibility.

In an expedient further development, the frame film and/or the base film and/or the cover film are connected via a welding connection, in particular laminated. This allows dispensing with glue, which is undesirable because of increased cleaning requirements and which is moreover expensive. In the case of an inside-situated valve this allows avoiding glue located on the side facing toward the product.

In an expedient further development, the base film is configured having a thickness between 0.1 mm and 0.25 mm, in particular of 0.125 mm, and/or that the frame film has a thickness between 0.1 mm and 0.2 mm, the cover film has a thickness between 0.05 mm and 0.15 mm, in particular of 0.1 mm, and/or the membrane has a thickness between 0.025 mm and 0.075 mm, in particular of 0.05 mm. Such film thicknesses are on the one hand especially suitable for a favorable manufacturability and on the other hand, in a connection with further geometries, they are suitable for an adjustment of preferred opening pressures for this field of application.

In accordance with the described steps of the production method, it is particularly expediently possible to utilize just one film, which is used as a basic material for the base film and/or for the frame film and/or for the cover film. Especially due to the folding and joining, fitting and/or feeding processes may dispensed with which would otherwise require additional input. Both the production of the opening and the production of the free region can be realized in one and the same step using just one punching tool. This further simplifies production. If the membrane is introduced in a state when the valves have not yet been separated from each other, a high degree of positional accuracy is achievable.

Further expedient implementations will become apparent from further dependent claims and from the description.

BRIEF DESCRIPTION OF THE DRAWINGS

Implementations of the invention will be described in detail with reference to the included figures. It is shown in.

DETAILED DESCRIPTION

In the following the exemplary embodiments of the invention will be described in detail with reference to the figures.

Figure 1:
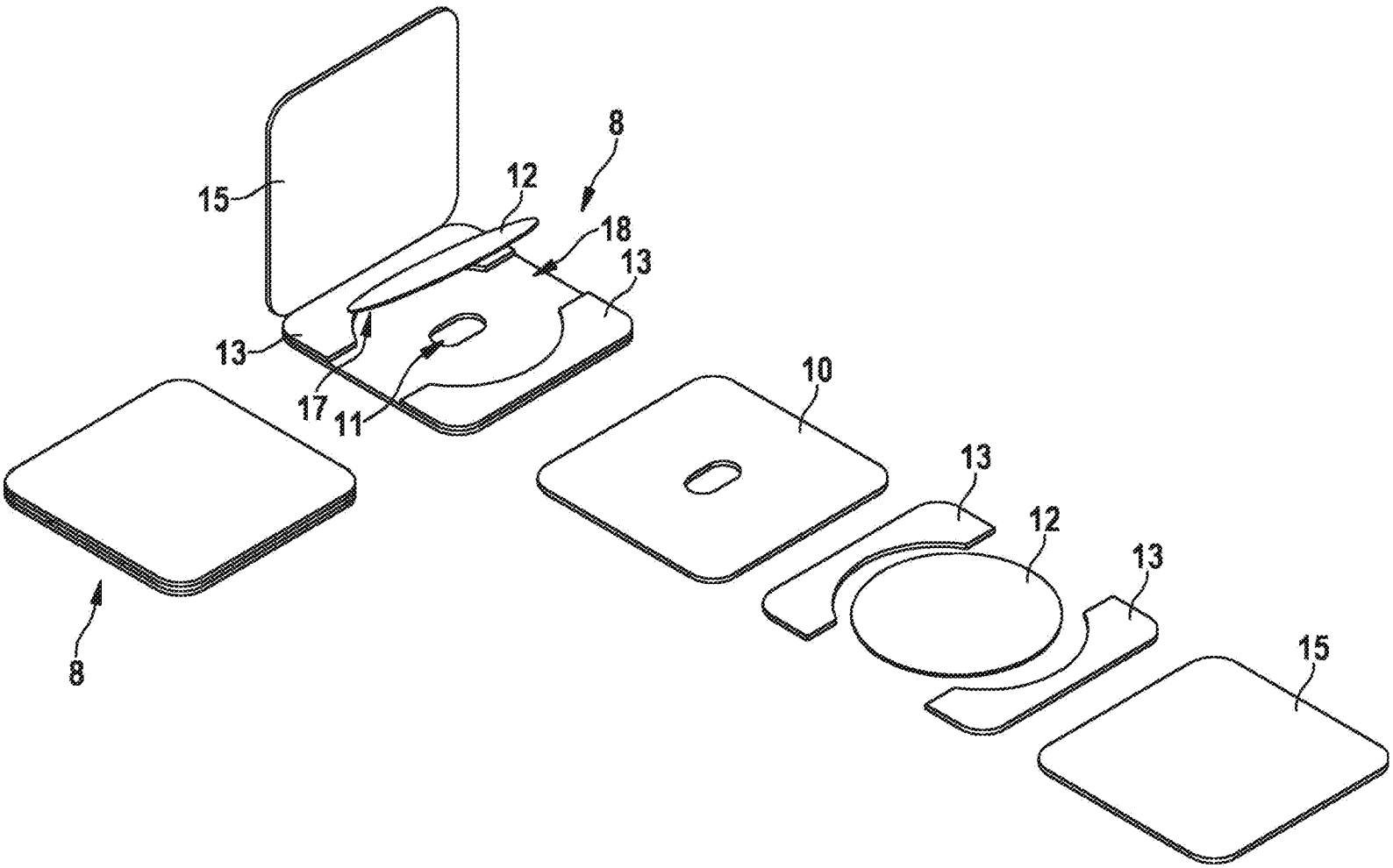
FIG. 1 the construction of a valve of a first exemplary embodiment for an outside-situated valve, FIG. 2 a further exemplary embodiment of an outside-situated valve having a round geometry, FIG. 3 a further exemplary embodiment of an inside-situated valve having a rectangular, respectively square geometry, FIG. 4 a further exemplary embodiment of an inside-situated valve having a round geometry, FIG. 5 a further alternative exemplary embodiment of a frame film.

FIG. 1 shows the individual components of a valve 8 according to a first exemplary embodiment. The valve 8 comprises a base film 10. The base film 10 is provided with an opening 11. By way of example, the opening 11 has the geometry of two intersecting and/or overlapping circles. However, any other geometries are conceivable. Particularly preferentially the geometry is adaptable to the desired opening pressures and closing pressures. Furthermore, at least one frame film 13 is provided. The frame film 13 is implemented in such a way that a membrane 12 is encompassed at least partly but in a loss-proof manner. For this purpose, the frame film 13 has a free region 17 which the membrane 12 is arranged in. In a mounted state, the membrane 12 will come to rest between the two portions of the frame film 13 shown in the exemplary embodiment. In the outside-situated valve 8 shown, moreover a cover film 15 is provided. In the mounted state, a fluid, respectively a fluid film, e. g. silicone oil, or biological fluids like palm oil, coconut oil or the like, is arranged between the base film 10 and the membrane 12. The membrane 12 is also implemented as a film. The membrane 12 covers the opening 11. To permit an overpressure to leave the packaging, the membrane 12 is capable of lifting off the opening 11, such that an overpressure in the packaging can be reduced toward an outside.

The exemplary embodiment of FIG. 1 has a rectangular basic shape, preferably a square basic shape. Thus the base film 10 and the cover film 15 are implemented in a rectangle shape, in particular in a square shape. The outer sides of the frame film 13 are aligned with the base film 10, respectively the cover film 15, which are aligned above, respectively underneath, the frame film 13. The membrane 12 is realized in a circular shape and is arranged centrically to the opening 11. The inner faces of the frame film 13 are formed at least partly in the shape of a partial circle, which results in a constant distance to the membrane 12. In this way the circular free region 17 is created. The frame film 15 encompasses the membrane 12 at least on two sides. As a result, two channels 18 are formed allowing an escape of the overpressure. The width of the channel 18 is smaller than the diameter of the membrane 12. This ensures that the membrane 12 remains within the frame film 13. Other geometries of the frame film 13 are also conceivable. Particularly preferentially these are such geometries of the frame film 13 having only one channel 18, as in such a case the frame film 13 is embodied in a one-part implementation. This is exemplarily shown in FIG. 5, wherein a free region 17 of the frame film 13 is open toward one side via only one channel 18. The channel 18 herein extends in parallel to the side surfaces. Essentially the implementation of the frame film 13 is such that the membrane 12, which is arranged between the base film 10 and the cover film 15 (respectively a packaging wall in case of an inside-situated valve 8), cannot leave this region. For this purpose the membrane 12 remains in the free region 17.

The valve 8 is built from several film layers. In the exemplary embodiment of FIG. 1, these are the base film 10, the membrane 12, the frame film 13 and (optionally for outside-situated valves 8) the cover film 15. For a production of the mounted valve 8, the film layers are produced, for example on punching tools, in particular rotary punching tools, and are then laminated. The joining of the film layers is preferably realized via a welding connection. The heat input suitable for the respective film thicknesses is provided by corresponding welding procedures, such that a fix connection of the different film layers (base film 10, frame film 13, optionally cover film 15) is created. Alternatively or additionally, the joining may be realized by an adhesive agent (glue).

The membrane 12 lies loosely on the base film 10. The membrane 12 is floatingly connected to the base film 10 via a fluid (not shown), which is arranged between the base film 10 and the membrane 12. The fluid makes the membrane 12 tightly adjoin the base film 10 by capillary forces, closing the opening 11 in a gas-tight manner, but allows the membrane 12 lifting off in case of overpressure. The sealing surface is thus the fluid film between the membrane 12 and the base film 10. For this purpose, the membrane 12 is introduced into the free region 17 that is encompassed by the frame film 13. The cover film 15 applied in the case of an outside-situated valve 8 protects the membrane 12 from external influences and prevents complete lifting of the membrane 12. The frame film 13 encompasses the membrane 12. The frame film 13 secures the position of the membrane 12.

Figure 2:
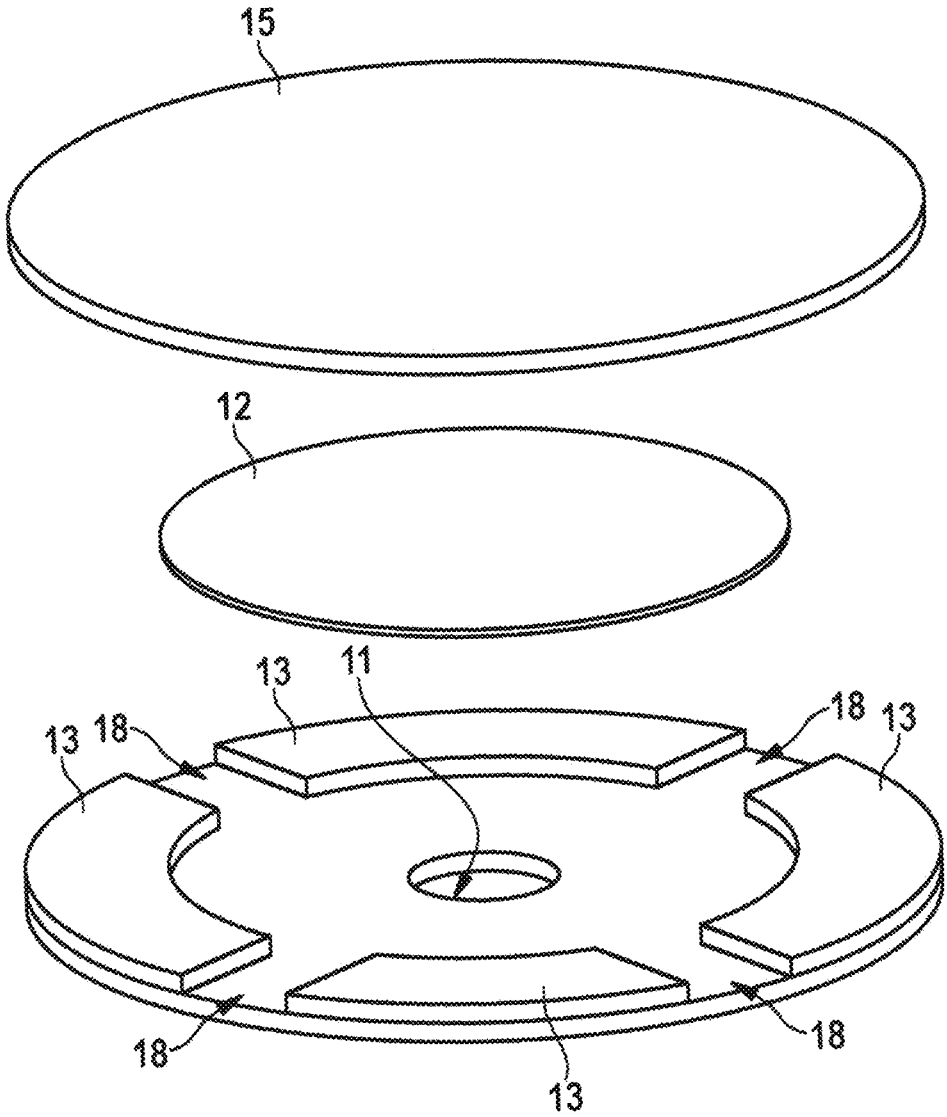

In FIG. 2 a further exemplary embodiment of the valve 8 is shown. It is distinguished by a circle-shaped geometry. The circle-shaped base film 10 has a centrally-arranged opening 11. The opening 11 is implemented in a circular shape. The frame film 13 is implemented of four partial films. The partial films of the frame film 13 are implemented respectively identically and on an edge side terminate flush with the outer contour of the base film 10. The frame film 13 encompasses the free region 17 which the membrane 12 is arranged in. The width of the partial films of the frame film 13 is constant, hence the edge oriented toward the membrane 12 also extends circularly. The partial films of the frame film 13 encompass the membrane 12. The membrane 12 is embodied in a circular shape. Between respectively two adjoining partial films in total four channels 18 are formed by the four partial films. The valve 8 is implemented as an outside-situated valve 8, and is thus arranged on the outer side of the packaging. The cover film 15 is in its turn configured for a protection of the membrane 12. The cover film 15 is implemented in a circular shape and is connected to the frame film 13. It corresponds to the contour of the base film 10. In the mounted state, the outer edges of the base film 10, the frame film 13 and the cover film 15 are aligned with each other. In the mounted state, a fluid film is provided between the base film 10 and the membrane 12. The membrane 12 in its turn lies loosely on the base film 10 in the free region 17. The fluid is situated in-between. The four channels 18 realize a connection between the free region 17 in the interior of the valve 8 and the environment.

Figure 3:
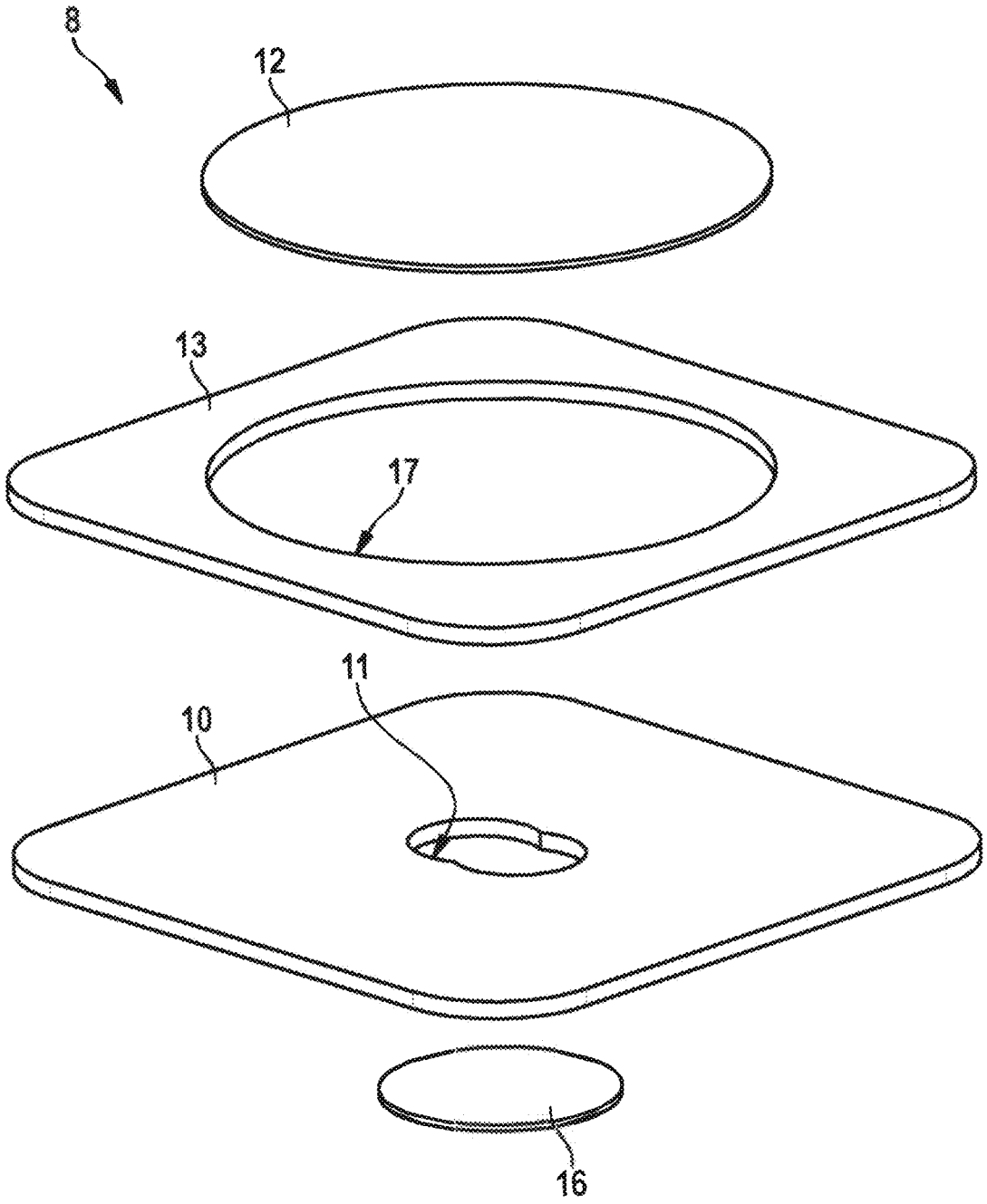

The exemplary embodiment of FIG. 3 shows an inside-situated valve 8; the valve 8 is thus arranged on the inner face of the packaging. The valve 8 is in its turn implemented of a base film 10. The base film 10 has at least one opening 11. The frame film 13 is arranged on the base film 10. The frame film 13 has a closed edge encompassing the membrane 12 completely. The region thus delimited is the circle-shaped free region 17. So no sidewise channels are formed. The membrane 12 is arranged loosely on the base film 10, namely in the free region 17. A fluid film is provided between the membrane 12 and the base film 10. In the mounted state of the valve 8, the upper side of the frame film 13 is connected to the inner face of the packaging. In the region of the membrane 12, the packaging has a small opening allowing the overpressure to escape after a short lifting of the membrane 12. The other side of the opening 11 is covered by a filter 16, in particular a nonwoven filter 16. The filter 16, respectively the nonwoven filter 16, is necessary so as to prevent particles of the filling material from entering into the valve 8 between the membrane 12 and the base film 10, which would affect functionality. In the exemplary embodiment the filter 16 is embodied in a circular shape. The exemplary embodiment of FIG. 3 is distinguished by a rectangle-shaped, in particular square, basic shape of the base film 10 and of the frame film 13. The membrane 12 is embodied in a circular shape. The inner contour of the frame film 13, the free region 17, is also embodied in a circular shape, correspondingly to the outer geometry of the membrane 12, with a slightly greater diameter than the membrane 12. The opening 11 exemplarily has the contour of two intersecting and/or overlapping circles.

Figure 4:
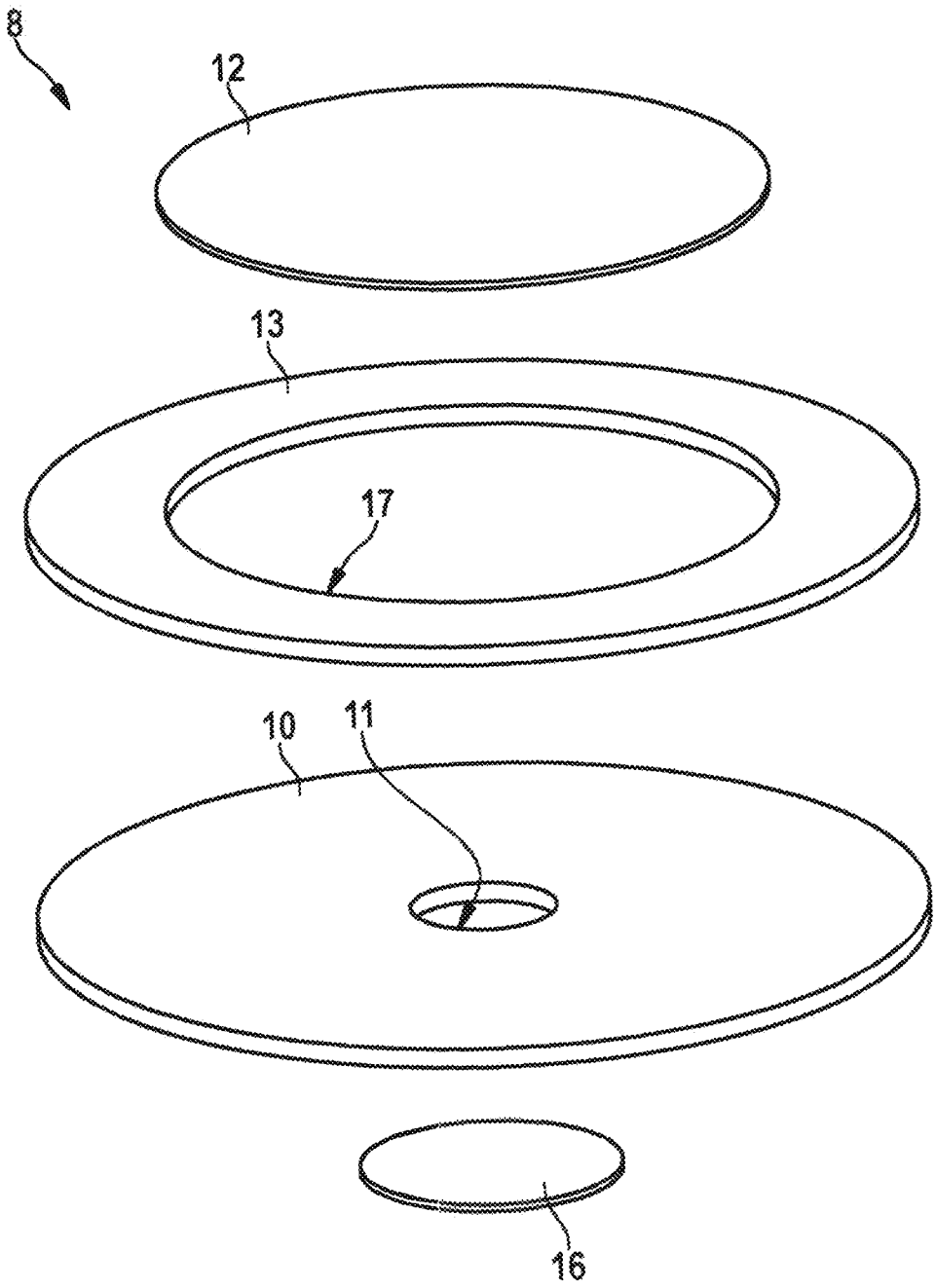

The exemplary embodiment of FIG. 4 shows an inside-situated valve 8 with a round contour. The base film 10 is embodied in a circular shape and has an opening 11 in its center. By way of example, the opening 11 is embodied in a circular shape. The frame film 13 is realized in a one-part implementation. The frame film 13 encompasses the membrane 12 completely. Thus no sidewise channels are formed. The other side of the opening 11, which faces away from the membrane 12, is covered by the filter 16, in particular a nonwoven filter 16. The filter 16, respectively the nonwoven filter 16, is necessary for preventing particles of the filling material from entering the valve 8 between the membrane 12 and the base film 10, which would affect functionality. In the exemplary embodiment the filter 16 is embodied in a circular shape. The frame film 13 has a circle-shaped inner diameter as well as a circle-shaped outer diameter with a constant width. In this way a circle-shaped free region 17 is formed. The membrane 12 is in its turn implemented in a circular shape. The diameter of the membrane 12 is smaller than the diameter of the free region 17. In the mounted state, the membrane 12 lies loosely on the base film 10 and is sealingly held by the fluid. The fluid is situated between the membrane 12 and the base film 10. The free upper side of the frame film 13 is connected to the inner face of the packaging. For a relief of the overpressure, the packaging has a small opening in the region of the membrane 12, respectively of the opening 11.

Figure 5:
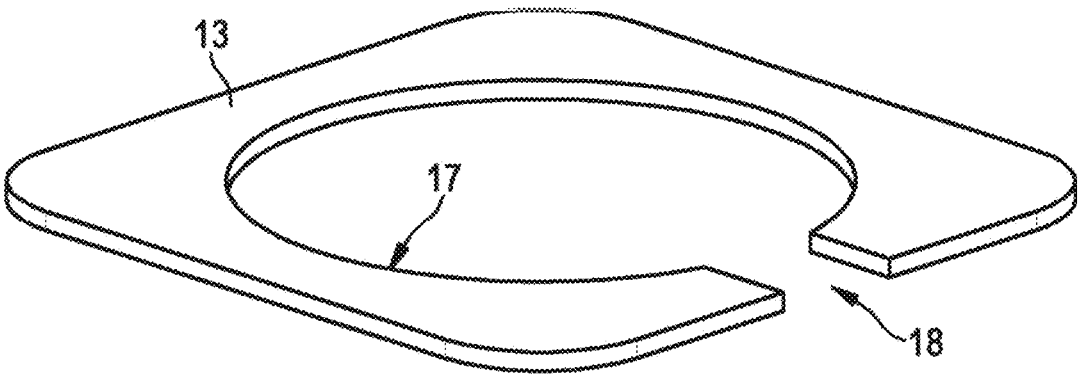

The frame film 13 of FIG. 5 is distinguished by only one opening in the frame film 13 such that a single channel 18 is formed. The free region 17 is in its turn implemented in a circular shape, with a diameter that is slightly greater than the diameter of the membrane 12. The frame film 13 is preferably embodied in a one-part implementation.

The connection of the base film 10 to the frame film 13 and/or of the frame film 13 to the cover film 15 is preferentially realized by a welding procedure. The films 10, 13, 15 are implemented so as to be weldable. The films 10, 13, 15 are preferentially made of a synthetic material. Particularly preferentially the valve 8 is implemented of films having the same material. Here polypropylene is especially suitable. As a result of the uniform material of the different films 10, 13, 15, re-usability is simplified. Utilization of synthetic materials based on sustainable raw materials or bio-degradable synthetic materials is also possible. For example, the base film 10 and/or the frame film 13 and/or the cover film 15 may be made of polypropylene, preferentially of OPP (oriented polypropylene), i. e. a propylene that is stretched longitudinally or biaxially. The base film 10 and/or the frame film 13 and/or the cover film 15 and/or the membrane 12 may alternatively be made of PET. Beyond this, multi-layer films are also conceivable, like for example PP-EVOH-PP. The material of the membrane 12 is distinguished by a high oxygen barrier. For example, the membrane 12 is made of PET.

The following geometries may be particularly suitable for the valves 8. In the exemplary embodiments of FIG. 1 respectively FIG. 3 (square basic shape), the edge lengths of the base film 10 may be in the range of preferably 12.5 mm and 20 mm. The thickness of the base film 10 is preferably in the range of 0.1 mm to 0.25 mm, and is particularly preferably for example 0.125 mm. The fluid, e.g. silicone oil, which is based on bio-based materials and/or sustainable raw materials, e.g. based on palm oil, coconut oil or the like, is applied as a fluid film. The volume of the fluid film is approximately 2 μl to 5 μl. The thickness of the membrane 12 is, for example, in a range of 0.025 mm to 0.075 mm, and is preferentially 0.05 mm. The thickness of the frame film 13 is, for example, in the range of 0.1 mm to 0.2 mm. The thickness of the frame film 13 is greater than the thickness of the membrane 12. The thickness of a possible cover film 15 is, for example, in the range of 0.05 mm to 0.15 mm, and is particularly preferentially 0.1 mm. Depending on application cases, material selection, connection methods etc., thicknesses may vary accordingly.

The described valves 8 are used, for example, as aroma-protection valves of packagings of outgassing products, like for example coffee beans, ground coffee, fresh dough or the like, in which an overpressure is produced within the packaging. Pressure relief is brought about by a lifting of the membrane 12 relative to the opening 11, the pressure then escaping via the free region 17, respectively—in the case of an outside-situated valve—via at least one sidewise channel 18, which is in a connection with the free region 17 and is implemented between the frame film 13 and the cover film 15.

What is claimed is:

1. A valve for a packaging container, comprising at least one base film (10) with an opening (11), at least one frame film (13) encompassing a free region (17), wherein the frame film (13) is connected to the base film (10), wherein at least one membrane (12) is provided, which is arranged on the base film (10) and covers the opening (11), wherein a fluid is provided between the membrane (12) and the base film (10), wherein the membrane (12) is arranged movably within the free region (17) on the base film (10), wherein the frame film (13) has at least one interruption such that at least one channel (18) is formed, and wherein the channel (18) extends within the frame film (13) unbroken from an outer perimeter of the frame film (13) to an inner perimeter of the frame film (13).

2. The valve according to claim 1, wherein the frame film (13) is implemented so as to encompass the membrane (12) at least partially or completely, such that the membrane (12) cannot leave the free region (17).

3. The valve according to claim 1, wherein the frame film (13) is embodied in a one-part implementation.

4. The valve according to claim 1, wherein the free region (17) is formed in a circular shape, with a radius that is greater than a radius of the membrane (12) that is embodied in a circular shape.

5. The valve according to claim 1, wherein the thickness of the frame film (13) is greater than the thickness of the membrane (12).

6. The valve according to claim 1, wherein the base film (10), the frame film (13) and the membrane (12) are equally usable and/or arrangeable within a packaging container or outside a packaging container.

7. The valve according to claim 1, wherein at least one cover film (15) is provided, which is connected to the frame film (13).

8. The valve according to claim 1, wherein at least one filter (16) is provided for covering the opening (11).

9. The valve according to claim 1, wherein the base film (10) and/or the frame film (13) and/or the cover film (15) are/is made of polypropylene, OPP, PET, polyolefin or of a synthetic material.

10. The valve according to claim 1, wherein the frame film (13) is connected to the base film (10) and/or to the cover film (15) via a welding connection.

11. The valve according to claim 1, wherein the base film (10) has a thickness between 0.1 mm and 0.25 mm and/or the frame film (13) has a thickness between 0.1 mm and 0.2 mm, and/or the cover film (15) has a thickness between 0.05 mm and 0.15 mm, and/or the membrane (12) has a thickness between 0.025 mm and 0.075 mm.

12. The valve according to claim 1, wherein the frame film (13) encompasses the membrane (12) at least on two sides, wherein at least two channels (18) are formed via which an overpressure can escape, wherein a width of the respective channel (18) is smaller than the diameter of the membrane (12).

13. The valve according to claim 8, wherein another side of the opening (11), which faces away from the membrane (12) is covered by the filter (16).

14. The valve according to claim 5, wherein the thickness of the frame film (13) is greater than the thickness of the membrane (12) by 75% to 225%.

15. The valve according to claim 8, wherein the filter is a nonwoven filter.

16. The valve according to claim 9, wherein the base film (10) and/or the frame film (13) and/or the cover film (15) are/is made of sustainable raw materials or bio-degradable synthetic materials.

17. The valve according to claim 10, wherein the frame film (13), the base film (10), and/or the cover film (15) are laminated together.

18. The valve according to claim 11, wherein the base film (10) has a thickness of 0.125 mm, and/or the cover film (15) has a thickness of 0.1 mm, and/or the membrane (12) has a thickness of 0.05 mm.

19. A valve for a packaging container, comprising at least one base film (10) with an opening (11) and at least one frame film (13) encompassing a free region (17), wherein the frame film (13) is connected to the base film (10), wherein the valve further includes at least one membrane (12) that is arranged on the base film (10) and covers the opening (11), wherein a fluid is provided between the membrane (12) and the base film (10), wherein the membrane (12) is arranged movably within the free region (17), wherein the frame film (13) includes an outer perimeter, wherein the outer perimeter of the frame film (13) is open at least in one point such that a channel (18) is formed in the frame film (13), and wherein the channel (18) extends within the frame film (13) unbroken from the outer perimeter of the frame film (13) to an inner perimeter of the frame film (13).

* * * * *